United States Patent [19]

Fleischer et al.

[11] Patent Number: 4,604,955

[45] Date of Patent: Aug. 12, 1986

[54] HEIGHT-ADJUSTABLE TABLE FOR WORK PLACES WITH VIDEO SCREEN

[75] Inventors: Joachim Fleischer; Willy Fleischer, both of Essen, Fed. Rep. of Germany

[73] Assignee: Willy Fleischer Metallwarenfabrik GmbH & Co., Bochum, Fed. Rep. of Germany

[21] Appl. No.: 509,434

[22] PCT Filed: Oct. 2, 1982

[86] PCT No.: PCT/EP82/00220

§ 371 Date: Jun. 2, 1983

§ 102(e) Date: Jun. 2, 1983

[87] PCT Pub. No.: WO83/01183

PCT Pub. Date: Apr. 14, 1983

[30] Foreign Application Priority Data

Oct. 3, 1981 [DE] Fed. Rep. of Germany ... 8128983[U]

[51] Int. Cl.[4] ..... A47B 9/00

[52] U.S. Cl. ..... 108/147; 108/106

[58] Field of Search ..... 108/96, 106, 144, 147; 248/422; 297/348; 74/545

[56] References Cited

U.S. PATENT DOCUMENTS

| | | | |
|---|---|---|---|
| 319,133 | 6/1885 | Schmitt et al. | 108/96 |
| 396,741 | 1/1889 | Healey | 108/96 |
| 429,458 | 6/1890 | Kraemer | 248/422 X |
| 885,748 | 4/1908 | Haggard | 108/106 X |
| 953,719 | 4/1910 | Skripec | 108/147 X |
| 1,189,606 | 7/1916 | Miller | 74/545 X |
| 2,368,748 | 2/1945 | Doty . | |
| 2,531,925 | 11/1950 | Taylor et al. | 108/147 |
| 3,385,238 | 5/1968 | Jay | 108/147 |

FOREIGN PATENT DOCUMENTS

| | | | |
|---|---|---|---|
| 2644668 | 4/1978 | Fed. Rep. of Germany | 108/96 |
| 2722278 | 11/1978 | Fed. Rep. of Germany | 108/144 |
| 2926759 | 1/1981 | Fed. Rep. of Germany . | |
| 180358 | 1/1936 | Switzerland . | |

*Primary Examiner*—William E. Lyddane
*Assistant Examiner*—James R. Brittain
*Attorney, Agent, or Firm*—Karl F. Ross; Herbert Dubno

[57] ABSTRACT

The table comprises a mounting with columns each comprised of a lower portion and of a telescopic upper portion. A cross-bar connects the upper portions. A height adjusting device acts on the upper telescopic portion which carries a plate for the keyboard and an independent height adjustable screen plate. Each plate has its own lower portions and upper portions and its own adjusting system. Each column has its own actuation handle arranged on the long side of the plate and comprising driving shafts for the height adjusting device of the keyboard plate and the screen plate. The driving shafts traverse the lower portion and the upper portion carrying the keyboard plate and the traversed upper portions are provided with oblong holdes for the driving shafts, of which the length corresponds at least to the adjusting travel. Such arrangement enables to house the driving shafts in an invisible manner and to support them in a simple way.

5 Claims, 6 Drawing Figures

HEIGHT-ADJUSTABLE TABLE FOR WORK PLACES WITH VIDEO SCREEN

CROSS REFERENCE TO RELATED APPLICATIONS

This application is a National Phase Application corresponding to PCT/EP 82/00220 filed Oct. 2, 1982 and based in turn upon a German application of Oct. 3, 1981.

FIELD OF THE INVENTION

The invention relates to a height-adjustable table for work places requiring a video screen, e.g. a video monitor, and more particularly to a table having a table stand with columns.

BACKGROUND OF THE INVENTION

A table of this type can have columns telescoping from the lower upright portion and with a cross-bar connecting the lower portions of the columns provided with a height-adjustment device for a telescopic keyboard plate on one hand and on the other hand for the upper portion of the columns supporting the video monitor, independently adjustable with respect to the keyboard plate, whereby the table stand for the keyboard plate and the screen plate is provided with columns having upper and lower portions and its own height-adjustment device and further with actuating means mounted on a wide side of the right- and left-hand columns of the table, with driving shafts for the height-adjustment of the keyboard plate on the one hand and of the video screen on the other.

A height-adjustable table of this kind is known wherein the two separately actuatable driving shafts for height-adjustment devices are mounted one on the right column and the other on the left column, with actuating knobs at the ends. But in this construction the driving shafts are visibly mounted on the outside of the table columns. This affects not only their appearance, but also requires additional constructions in order to connect the driving shafts to the otherwise separated cross-bars for the table columns corresponding to the keyboard plate on the one hand and to the video screen plate on the other.

OBJECT OF THE INVENTION

It is the object of the invention to overcome this drawback and to provide a height-adjustable table for work places with a video monitor of the aforedescribed kind, whereby the actuating shafts for the height-adjustment devices are located inside the table stand practically invisible and supported in a simple manner.

SUMMARY OF THE INVENTION

The invention attains the object in a height-adjustable table of this kind by having the actuating shafts traverse both lower and upper portions of the column for the keyboard plate and by having vertical slotted holes in the pierced upper portion of the column for the passage of the actuating shafts, said holes having lengths at least equal to the travel. As a result the table stand, or the table columns are designed for the support and housing of the actuating shafts and in addition only the actuating devices for these shafts, that must be positioned outside are visible at the lower end on the front part of the table. Basically, there is also a possibility within the framework of the invention to arrange the driving shafts to pass through both the lower and the upper portions of the column for the plate of the video screen, resulting in the positioning of the actuating devices of the driving shafts at the rear side of the table according to the invention.

According to the invention the driving shafts can be mounted in the lower column portions and/or in the cross-bar connecting jointly the lower column portions, the cross-bar having end bearings for the driving shafts, for this purpose. Thus a complete covering of the driving shaft actuating the rear height-adjustment device for the plate of the video screen results.

For a table having as height-adjustment devices screw spindles with spindle nuts mounted in a vertical position on the lower portions of the columns and the cross-bar, said spindles being connected with the telescopic upper portions of the columns via a bridge gripping through a guide slot in the lower portions of the columns, the meshing bevel gears or worms and worm gears are mounted at the inside of the cross-bar on the driving shafts and the upper end of the spindles for the individual height-adjustment of the keyboard plate and of the video-screen plate according to the invention.

Further, it is possible to provide over the length of the cross-bar connecting shafts ending with bevel gears for the spindles of the height-adjustment devices, resulting in a tilt-free height adjustment of the upper portion of the columns in the lower portions of the columns, although the drive occurs one-sidedly, namely by means of the driving shafts located on one hand in the right table column and on the other hand in the left table column. The synchronous height adjustment of both sides is accomplished by means of the connection shafts.

On the ends of the driving shafts extending beyond the lower portion of the columns replaceable operating means, such as actuating knobs, crank handles, handwheels or the like can be mounted. Advantageously, the projecting ends of the driving shafts have plug devices shaped as disks with plug-in recesses for rotational mounting of crank handles so that, with only one crank handle, both driving shafts can be actuated alternatively.

The advantages obtained by the invention are to be seen mainly in the fact that a height-adjustable table for a video monitor is created, whereby the driving shafts are placed practically in their totality inside the table stand, respectively in the right table column on one hand and in the left table column on the other. From this practically invisible arrangement of the driving shafts results on one hand an embodiment satisfactory from the esthetic point of view and on the other hand a simplified way of supporting the driving shafts. That because the lower portions of the columns, anyway available, and the cross-bars connected to them can be used for support. As a result, only the actuating devices for the driving shafts, for instance hand knobs or crank shafts, remain visible.

BRIEF DESCRIPTION OF THE DRAWING

The invention is described in greater detail with reference to the drawing representing only one embodiment, and in which.

SPECIFIC DESCRIPTION

Figure 1:
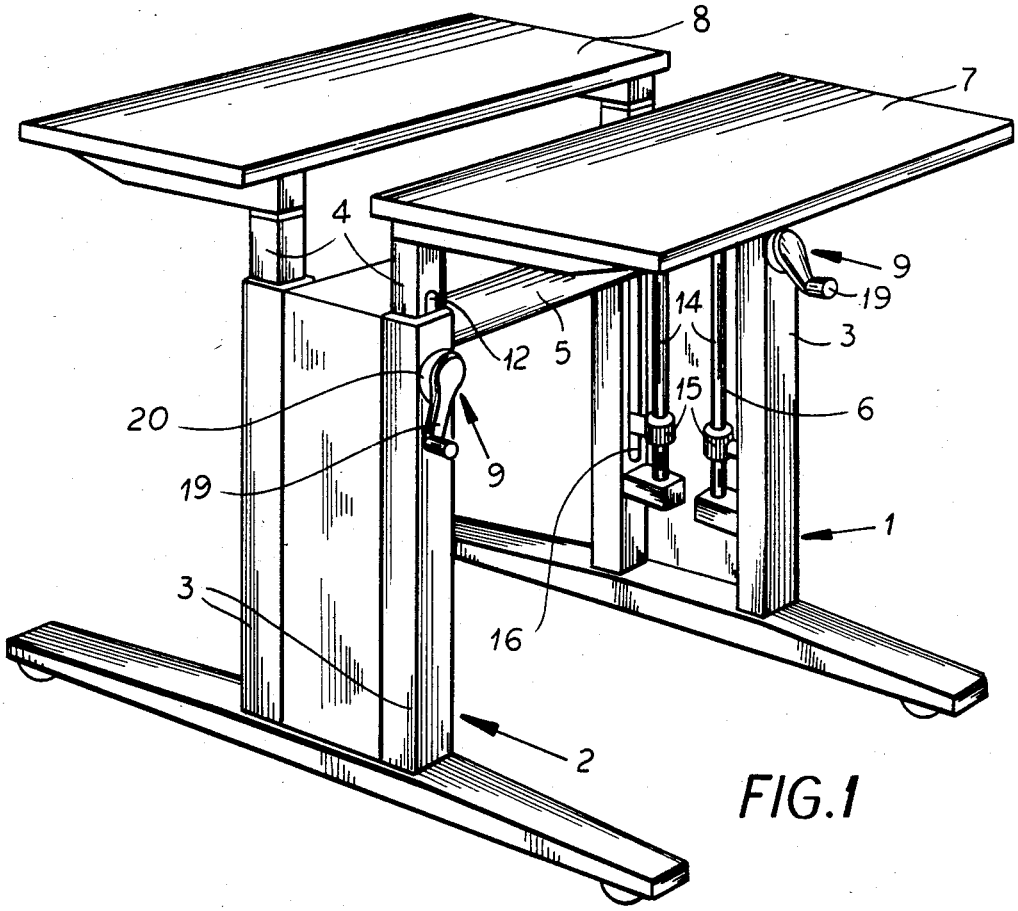
FIG. 1 is a table according to the invention in a perspective view.
Figure 4:
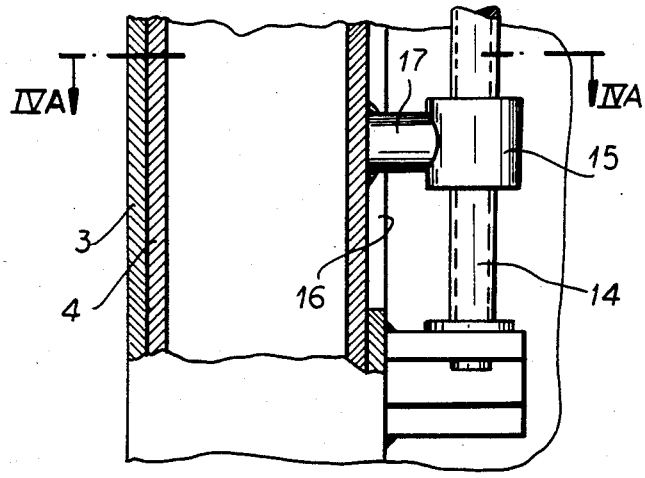
FIG. 4 is an elevational view partly broken away of a portion of one of the uprights.
Figure 4A:
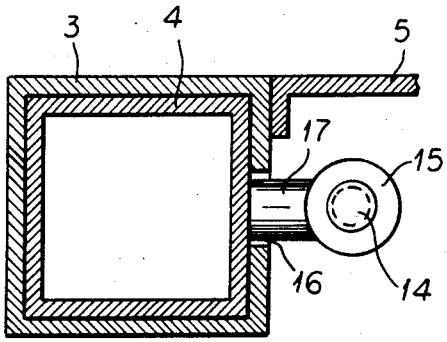
FIG. 4A is a horizontal section taken along the line IVA—IVA of FIG. 4.
Figure 2:
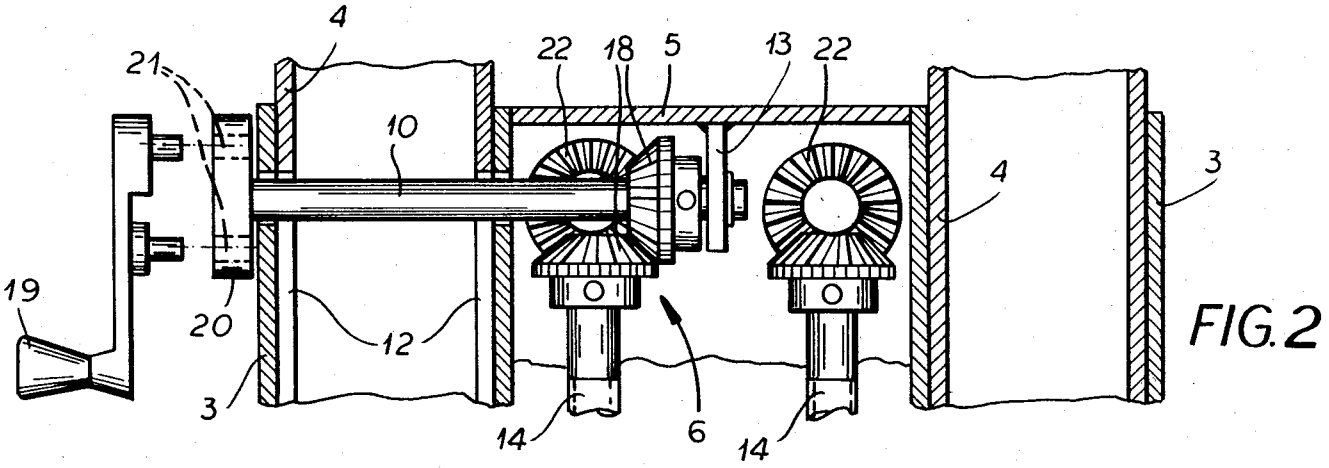
FIG. 2 is a partial vertical section through the table column for the height adjustment of the keyboard plate.
Figure 3:
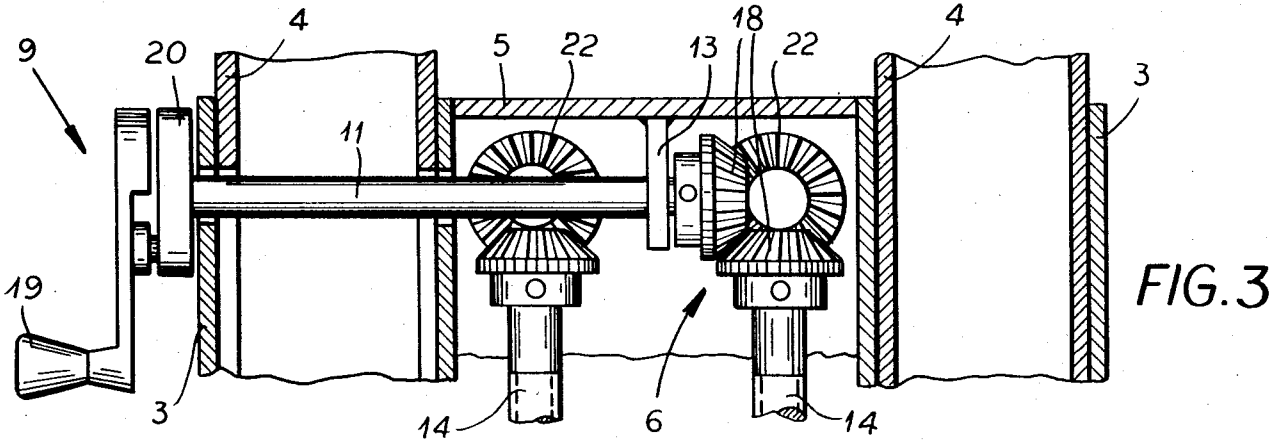
FIG. 3 is a partial vertical section through the table columns for the height adjustment of the video-screen plate.

In the figures a height-adjustable table for work places with a video monitor is illustrated, the table having a table stand with columns 1,2 comprising upright lower portions 3 of the columns and telescopic upper portions 4 and with a cross-bar 5 connecting the lower portions 3 of the columns with height-adjustment devices 6 for telescoping on one hand of a keyboard plate 7 and on the other of a video-monitor plate 8, supported by the upper portions 4 of the columns.

The table stand for the keyboard plate 7 and the video-monitor plate 8 have each their own lower portions 3 of the columns, upper portions 4 and their own height-adjustment devices 6.

Further, on the wide side of the right table column 1 and the left table column 2 actuating devices 9 with driving shafts 10, 11 provided for the height-adjustment device 6 of the keyboard plate 7 on one hand and of the video-monitor plate 8 on the other, are mounted.

The driving shafts 10, 11 pass through each of the lower portions 3 of the columns and the upper portion 4 of the keyboard plate 7. The traversed upper portions 4 of the columns have oblong vertical holes 12, having at least the length of the travel for the driving shafts 10, 11 engaging therethrough. The driving shafts 10, 11 are mounted in the lower portions 3 of the columns and/or in the cross-bar 5 connecting all the lower portions 3 of the columns, whereby the cross-bar 5 is provided with end bearings 13 for the driving shafts 10, 11. The table has a height-adjustment device 6 comprising screw spindles 14 with spindle nuts 15 mounted in vertical position on the lower portions 3 of the columns and the cross-bar 5, said spindles being connected with each of the telescopic upper portions 4 of the columns via a bridge 17 gripping through a guide slot 16 in the lower portions 3 of the columns. At the inside of the cross-bar 5 on the driving shafts 10, 11 and on the upper end of the spindle 14 meshing bevel gears 18 are mounted for separate height adjustment of the keyboard plate 7 and the video-monitor plate 8. On the ends of the driving shafts 10, 11 extending beyond the lower portions 3 of the columns interchangeable handle means 19 are detachably mounted. The protruding ends of the driving shafts 10, 11 have plug-in devices shaped as disks 20 with plug-in recesses 21 for alternately attaching a crank handle 19.

Figure 5:
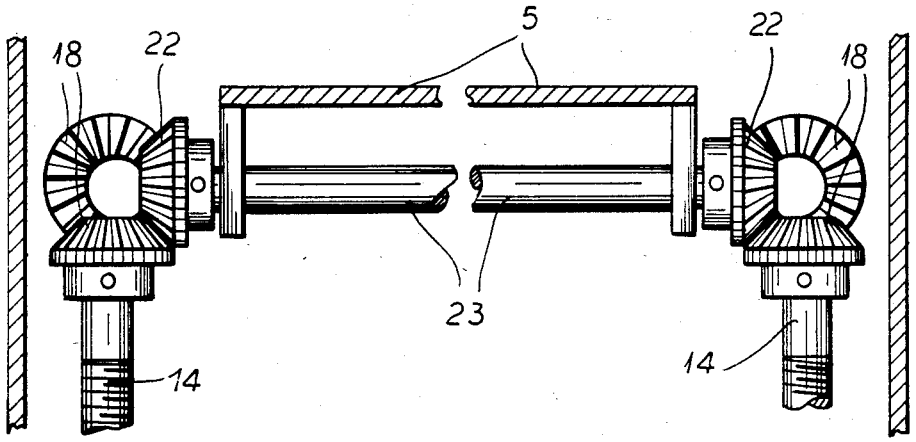
FIG. 5 is a vertical section taken along line V—V of FIG. 2.

As seen in FIG. 5 each of the bevel gears 18 of each spindle 14 meshes with a respective bevel gear 22. Two shafts 23 extending through the traverse 5 connect the front and back pairs of such bevel gears 22 so that when the one set of bevel gears 18 on one side of the table is rotated, the corresponding pair on the opposite side is identically rotated. This prevents canting of the table portions 7 and 8 in the legs 3.

We claim:

1. A height-adjustable stand for a work place with a video monitor and a keyboard, the stand having a pair of horizontally spaced opposite sides and comprising:

respective back telescoping columns at the sides and provided with lower portions and upper portions vertically telescoping with said lower portions;

a video-monitor table supported on the upper portions of the back columns and extending between the sides;

respective front columns adjacent the back columns at the respective sides and having lower portions and upper portions telescoping within the latter lower portions;

a keyboard plate supported on the upper portions of the front columns adjacent the video-monitor table;

a horizontal crossbar connecting the lower portions of said columns on one of the sides with the lower portions of the columns of the other side of said stand, the upper portions of the columns supporting said video-monitor table being adjustable independently as to height with respect to the upper portions of the columns supporting the keyboard plate; and actuating means on said sides at least partly concealed by said columns for adjusting said upper portions, the actuating means including:

respective upright front and back spindles at each of the sides, respective means coupling the front spindles to the upper portions of the respective front columns and the rear spindles to the upper portions of the respective rear columns for vertically displacing same on rotation of the respective spindles, front link means operatively connecting the front spindles together for joint rotation, rear link means operatively connecting the rear spindles together for joint rotation, respective driving shafts at the stand sides horizontally traversing both the upper and lower portions of the front columns, the upper portions of each front column being formed with a vertically elongated oblong hole through which the respective shaft passes and of a length at least equal to the travel of the respective upper portion, and means including an input gear on each of the shafts and an output gear at each of the sides on one of the respective spindles and meshing with the respective input gear for raising and lowering said upper portions of said columns, each of said lower portions fully enclosing the respective upper portion except where each upper portion stands out of the top of the respective lower portion.

2. The improvement defined in claim 1 wherein said driving shafts are mounted in the lower portions of the columns traversed by said shafts and said crossbars are provided with end bearings journaling said shafts.

3. The improvement defined in claim 2 wherein said shafts extend at least partially into said crossbars.

4. The improvement defined in claim 2, further comprising detachable handle means removably connected to each of said shafts at an end thereof projecting from a respective one of said lower portions.

5. The improvement defined in claim 4 wherein said ends of said shafts projecting from the respective lower portions have plug-receiving connectors, said handle means having plugs engageable in said connectors.

* * * * *